United States Patent [19]

Rudden, Jr.

[11] 4,190,256

[45] Feb. 26, 1980

[54] PATH FORMING GAME

[76] Inventor: Thomas J. Rudden, Jr., 6201 Hardy Dr., McLean, Va. 22101

[21] Appl. No.: 892,130

[22] Filed: Mar. 31, 1978

[51] Int. Cl.[2] ..... A63F 3/00

[52] U.S. Cl. ..... 273/275

[58] Field of Search ..... 273/258, 271, 275, 294

[56] References Cited

U.S. PATENT DOCUMENTS

| | | | |
|---|---|---|---|
| 526,373 | 9/1894 | Boyer | 273/258 |
| 1,362,318 | 12/1920 | Hydes | 273/294 |
| 2,162,876 | 6/1939 | Barton | 273/275 X |
| 2,571,195 | 10/1951 | Buck | 273/275 X |
| 2,585,268 | 2/1952 | Olsen | 273/275 X |
| 3,791,649 | 2/1974 | Gold | 273/258 X |

*Primary Examiner*—Harland S. Skogquist

*Attorney, Agent, or Firm*—Bernard & Brown

[57] ABSTRACT

A game apparatus which may be played by two or more players, having playing pieces in the shape of equilateral hexagons for each player and a pre-marked game board having a matrix of contiguous spaces disposed thereon in the shape of equilateral hexagons which accommodate the playing pieces. At least two different types of playing pieces (and as many as three types) may be provided, i.e. offensive pieces and defensive pieces, and optionally hybrid pieces known as offensive-defensive pieces. The offensive playing pieces are of a variety of different types all of which provide a distinctive, continuous path from one peripheral edge of the piece to at least one other peripheral edge. The defensive pieces are provided in a variety of types all of which provide a distinctive, non-continuous path. Offensive-defensive pieces have characteristics of both offensive and defensive playing pieces. The object of the game is for each player, or team of players, to form a continuous, distinctive path from designated starting spaces to designated ending spaces.

10 Claims, 7 Drawing Figures

FIG 1
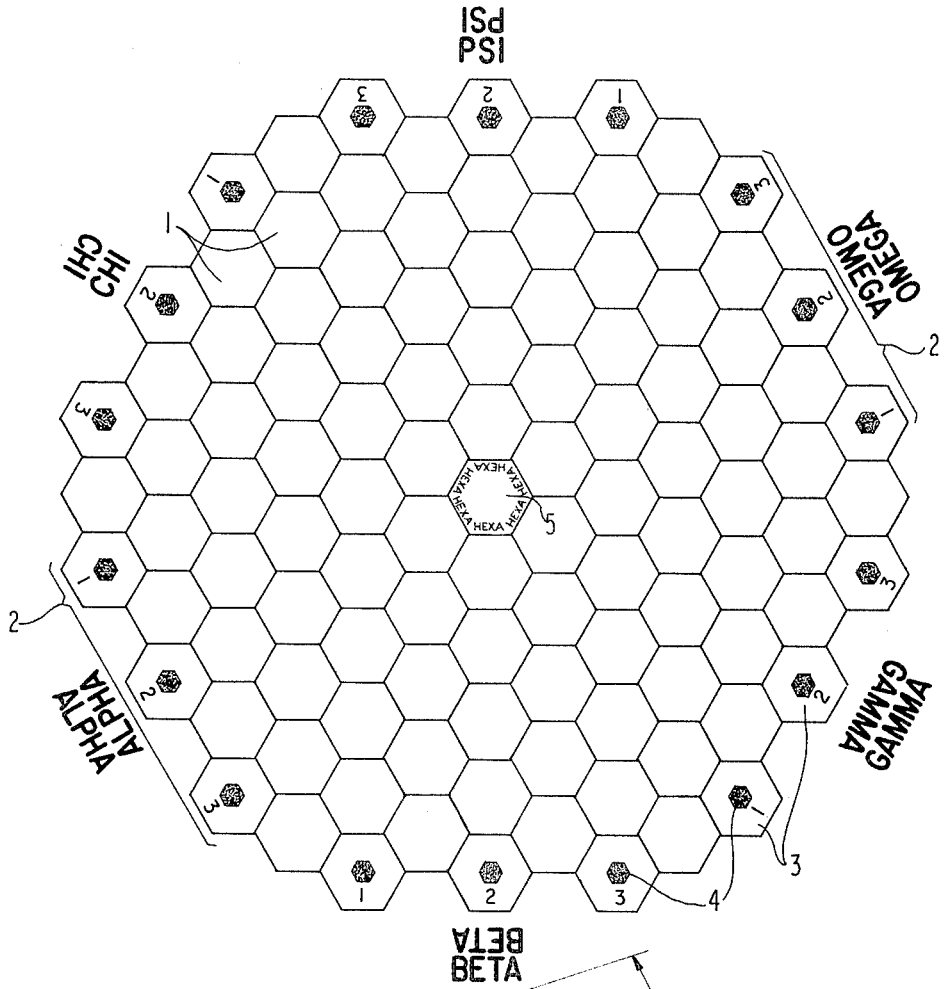
FIG 2
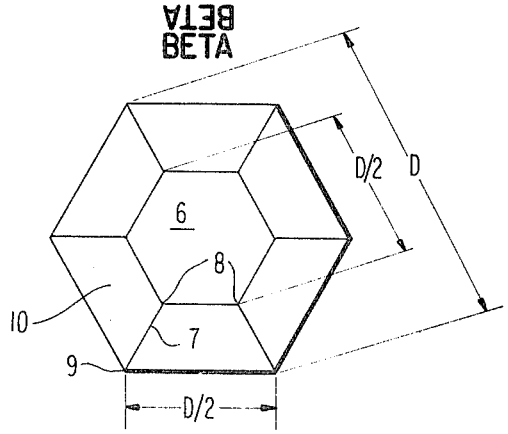
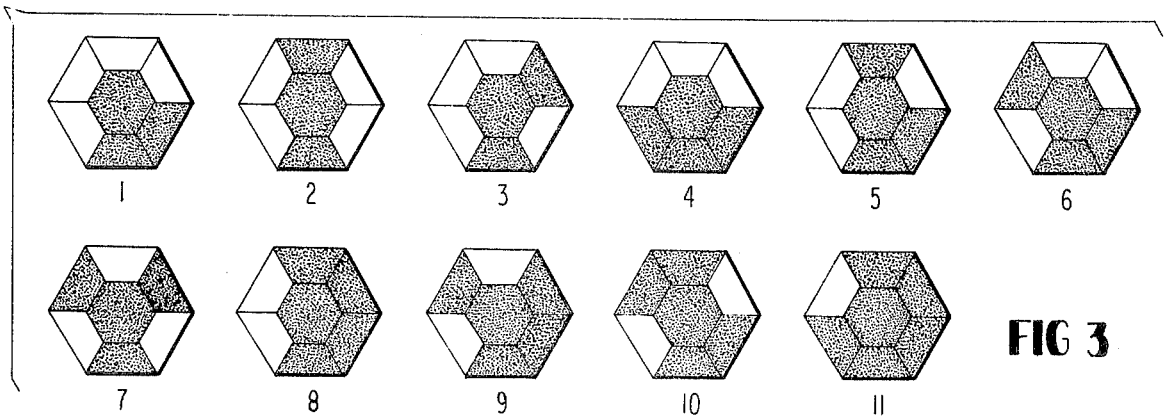
FIG 3

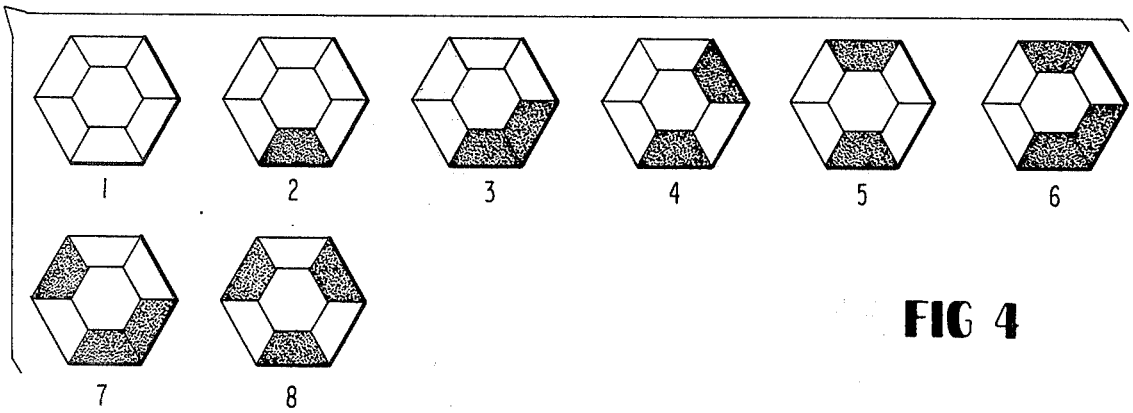
FIG 4
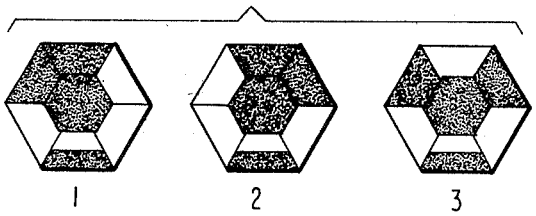
FIG 5
FIG 6
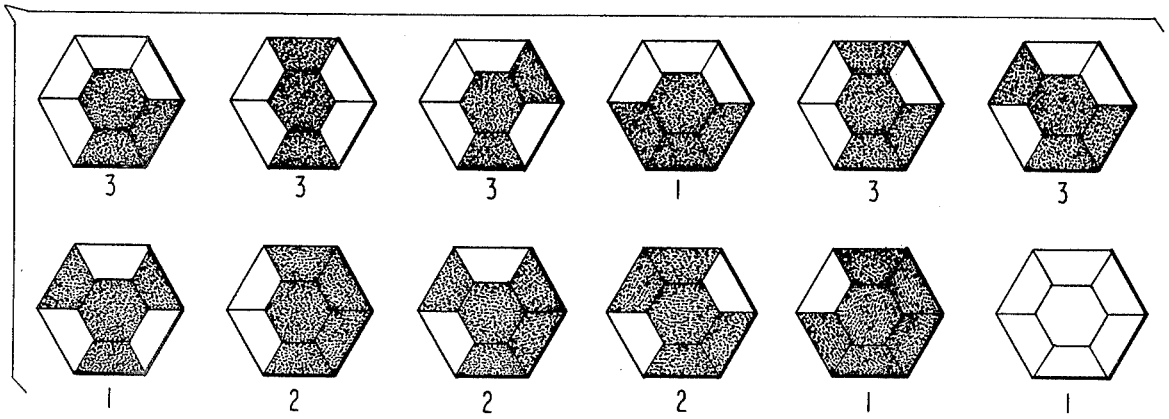
FIG 7
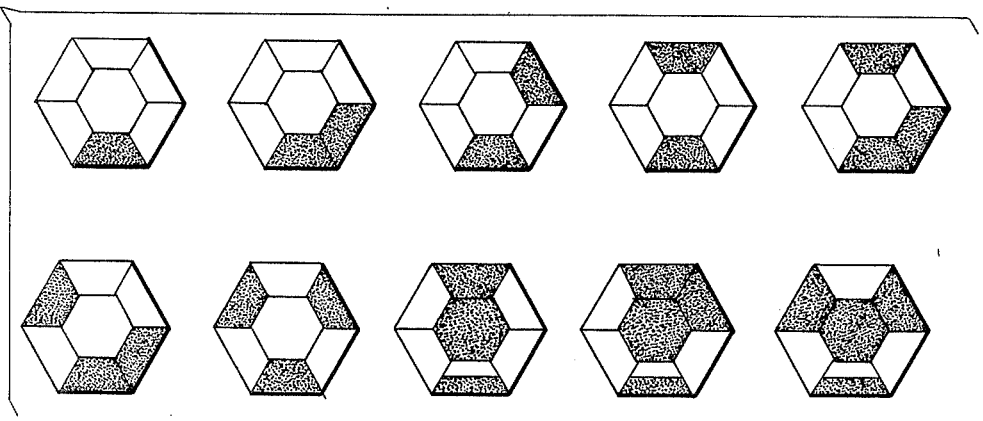

PATH FORMING GAME

BACKGROUND OF THE INVENTION (1) Field of the Invention

This invention relates to a game of skill and judgment which may be played by two or more players on a hexagonal game board having a matrix of contiguous hexagonally-shaped spaces disposed thereon, and in which playing pieces in the shape of an equilateral hexagon are alternately played by each player in an attempt to form a continuous path on the board defined by a distinctive color or design on certain of the playing pieces. Different categories of playing pieces, all of which are the same general shape and size, may be provided, i.e. offensive pieces, defensive pieces, and offensive-defensive pieces.

(2) Description of the Prior Art

Game boards having playing pieces which may be played by two or more players by alternately placing the pieces on a pre-marked board to construct a line or similar designation from one peripheral edge of the board to another edge are known. For instance, U.S. Pat. No. 3,404,890 to Christy relates to a game apparatus played on a game board in which the object of forming a path across the board is accomplished by the placement of mechanical pieces or links on the board. The links must be connected to posts of the same color in order to form a continuous path. The players may block the chains the opponent is trying to build by means of rods which are adapted to be placed inside one or more hollow cylinder members or post members which are mounted on the board.

Game boards having octagonal playing pieces which two or more players may alternately place on a pre-marked board are disclosed in U.S. Pat. No. 3,695,615 to Shoptaugh. In such game apparatus, octagonal pieces when placed together will define a square shape at the center thereof. Each of the playing pieces has at least one line across the piece in different configurations. The squares drawn at the centers of the octagonal pieces may also have lines across them in different configurations. The object of the game is to line up the pieces in such a way that a continuous line is formed across the board from one starting line to another, making use of both the lines on the octagonal playing pieces and on the squares.

Game boards having an array of hexagonally-shaped apertures or spaces therein and a plurality of hexagonally-shaped pieces adapted to fit in the apertures or spaces are also known as disclosed in U.S. Pat. No. 3,992,010 to Mattenson. In such game apparatus the playing pieces include an arrow-shaped direction indicator on each piece and a travel distance indicator. The object is to end at the point of beginning or at some other preselected point with a limited selection of varied distance movements available to be selected by each player.

Generally, such path puzzle games of the type described above are either too simple to challenge the skill and judgment of the adult player after he has once mastered the basic rules and technique of play, or the rules and strategy involved are too complicated for children to master. It is furthermore found, with regard to such games, that play between an adult who has once mastered the rules and techniques of strategy and a child or another adult who has never before played the game is not challenging or interesting due to the different levels of skill and relative sophistication of the players.

The game apparatus of the present invention is designed to provide a game of skill and judgment, which can be played by two, three, four, or six players, that is relatively simple for children to understand, but that is also challenging for the adult player who has once mastered the basic rules as well as the techniques of strategy and tactics involved in playing the game at a high level of sophistication. The game may be played at many different levels of skill, and many varieties of the standard game may be played. Players with different relative levels of skill, furthermore, may play a competitive and interesting game by utilization of various handicapping techniques, several examples of which will be described herein.

SUMMARY OF THE INVENTION

A game apparatus is provided for two or more players which includes a set of offensive playing pieces for each player in the shape of an equilateral hexagon which are marked for identification and a pre-marked game board, also in the shape of an equilateral hexagon, having a matrix of contiguous spaces provided thereon each of which is of a suitable size and shape to accomodate a playing piece. The offensive playing pieces are provided with a distinctively identified interior section and at least two peripheral sections that are similarly identified thereby defining a distinctive path from one peripheral edge of the offensive piece to at least one other peripheral edge.

The game apparatus is also provided with a pool of defensive pieces of the same size and shape as the offensive pieces. The defensive pieces are defined by the absence of a distinctively identified interior section so that no distinctive path is provided by the defensive pieces. The defensive pieces may be provided with at least one distinctively identified peripheral section, although generally at least one defensive piece has no distinctively identified peripheral sections. The game apparatus may optionally also include hybrid playing pieces, known as offensive-defensive pieces, which have characteristics of both offensive and defensive playing pieces.

The object of the game is to form a continuous path comprised of the distinctively identified sections of the offensive pieces across the board from one of a set of designated starting or ending spaces, generally on the periphery of the board, to another of a set of peripheral spaces, generally on the opposite side of the board by alternating the placement of pieces by the players on the contiguous spaces provided on the board. The path a player creates is not restricted to the path formed by his pieces only and any path formed by any or all of the other players may be included in the winning path of a particular player. Since the first player to complete a path wins, defensive pieces can be used to block the formation of a path by an opponent. Offensive-defensive pieces may be used to block an opponent's path while simultaneously maintaining the space upon which it is played available for the completion of a player's own path.

BRIEF DESCRIPTION OF THE DRAWINGS

FIG. 1 is a view of a game board of the invention which includes a matrix of 109 equilateral hexagons.

FIG. 2 is an illustration of the basic design of the playing pieces.

FIG. 3 is an illustration of the different types of offensive playing pieces.

FIG. 4 is an illustration of the different types of defensive playing pieces.

FIG. 5 is an illustration of the different types of offensive-defensive playing pieces.

FIG. 6 is an illustration of a typical set of playing pieces that are provided for each player at the start of play. The number below each piece shows the number of pieces of each type that are provided in a typical set.

FIG. 7 is an illustration of a typical pool of defensive pieces that may be provided which may be purchased with offensive pieces from a player's set provided at the start of play.

DESCRIPTION OF PREFERRED EMBODIMENT

As indicated above the game board of the invention illustrated in FIG. 1 is comprised of a matrix of playing spaces 1 which are all in the shape of an equilateral hexagon. The game board includes a matrix of 109 spaces, and the overall shape of the board itself is an equilateral hexagon, each side 2 of which is provided with three starting or ending spaces 3, identified by a small solid internal hexagon 4. The starting or ending spaces 3 are numbered one, two, and three on each side of the board. Each side of the board is identified, and in the embodiment illustrated in FIG. 1, the six sides are labelled alpha, beta, gamma, chi, psi, and omega. The wording HEXA appearing six times in design form in the central space 5 on the board has no significance in the actual play of the game and is for esthetic and identification purposes only. The material from which the game board is constructed may be of any suitable material from which game boards are known to be made, such as cardboard, Masonite, sheet plastic, metal (non-magnetized or magnetized) or the like. Indentations may be provided in the playing spaces which will accept similarly-shaped protuberances on the bottom of the playing pieces in order to anchor the pieces in place as will be apparent to those skilled in the art.

Where a game board of the type illustrated in FIG. 1 is employed, the playing pieces may be of about the same size and shape as the spaces on the board.

FIG. 2 is an illustration of the basic design of the playing pieces. Each piece is an equilateral hexagon having a diameter D with an interior section or segment imprinted thereon also in the form of an equilateral hexagon whose diameter D/2 is one-half of the diameter D of the piece. The shape of the interior segment may be any convenient shape, as will be apparent to those skilled in the art. Radii 7 from the corners 8 of the interior section 10 connect to the corners 9 of the piece forming six half hexagon peripheral sections 10. The playing pieces used in the game, namely the offensive pieces, defensive pieces, and offensive-defensive pieces are all of the same exterior dimensions as the general design illustrated at FIG. 2. The playing pieces may be made of any stamped or molded plastic, wood, metal (magnetized or non-magnetized), synthethic or real stone, ivory, or any other material which could be formed or imprinted to make the pieces. All pieces, according to the preferred embodiment, include at least the outline of the interior equilaterial hexagon as well as radii connecting the corners of the interior hexagon to the corners of the piece forming the peripheral sections.

The offensive pieces are formed by creating a distinctive color, texture, or design by any means known in the art in the interior section. Also, two or more of the peripheral half hexagons are provided with a similar or preferably identical path defining color, texture, or design thereby creating a "path" of the same color, texture, or design from one or more edges of the offensive piece through a half hexagon into the center of the piece and then out through one or more of the half hexagons to another edge or edges of the piece. The different types of offensive pieces in a set may be provided by varying the number and location of distinctively identified peripheral segments. Those segments of the offensive pieces which are not distinctively marked to form the "path" bear a different identifying color, texture, or design which preferably serves to identify the offensive piece as that belonging to a particular player. FIG. 3 illustrates the various types of offensive pieces which may be used to play the game.

The defensive pieces are commonly characterized in that the interior segment is not distinctively identified to define a path through the piece. Instead, the interior hexagon is neutral. One or more peripheral half-hexagon sections may be provided on certain of the defensive pieces bearing the same distinct identification which creates the path on the offensive pieces for reasons that will become apparent hereinafter. FIG. 4 illustrates the various types of defensive pieces.

The offensive-defensive pieces are substantially identical to the offensive pieces except that the outer half of one of the peripheral half-hexagon sections bears the same color, texture, or design as the path of the offensive pieces while the inner half of the peripheral half hexagon section (i.e. that portion which adjoins the interior hexagon section) is not distinctively identified thereby interrupting the path therethrough. FIG. 5 illustrates the various types of offensive-defensive pieces that may be provided.

Typical Rules of the Game

Although the number of pieces which may be provided for each player in the game may vary depending on the number of players, the level of skill at which it is desired to play, and the agreed-upon handicapping between the players, pursuant to a typical set of rules, one set of playing pieces is provided for each player, comprising 24 offensive pieces of eleven different types, and one defensive piece as illustrated in FIG. 6. In addition to the one defensive piece provided for each player, additional defensive pieces and/or offensive-defensive pieces may be purchased from the Defensive Pool, generally with two offensive pieces. A typical Defensive Pool comprises different types of defensive pieces and offensive-defensive pieces with one piece of each type being provided in the pool depicted in FIG. 7.

The starting player may be chosen by lot or by throw of the dice or any other convenient means. Thereafter, individual players, playing in rotation, may place a piece anywhere on the board including an opponent's starting or ending space, with the provision that if a player chooses to place pieces in the opponent's starting or ending spaces, he must leave at least one path open to the board. The starting and ending sides are dependant upon the number of players and the variety of game the players desire to play, for instance, as follows:

2 Players.

ALPHA to OMEGA and BETA to PSI, or ALPHA to OMEGA and GAMMA to CHI

3 Players.

ALPHA to OMEGA, GAMMA to CHI, and PSI to BETA

4 Players.

ALPHA to GAMMA, BETA to CHI, PSI to GAMMA and OMEGA to CHI

6 Players.

ALPHA to GAMMA, BETA to OMEGA, GAMMA to PSI, OMEGA to CHI, PSI to ALPHA and CHI to BETA.

When a player places a piece of any type such that it touches another piece (or pieces), the distinctively identified section (path defining section) must touch a correspondingly identified segment of the piece which it adjoins. Defensive pieces with one or more distinctively identified peripheral sections may be used for this purpose when it is desired to block an opponent's path using a space that adjoins a space which is already occupied by another piece bearing a distinctly identified peripheral section.

Generally, when it is a player's turn, he will use one of his offensive pieces in an attempt to define a path from his starting to his ending position. The path a player creates is not restricted to the path formed with his pieces only. Any continuous path formed by any, or all, of the players can be included in the winning path. At any time when it is a player's turn, however, he may alternatively trade two of his offensive pieces for one piece from the defensive pool of pieces and then play that defensive piece. The defensive piece may be used to interrupt an opponent's path or to occupy an opponent's starting or ending space. Only two pieces can be played in an opponent's starting or ending spaces during a game. Also, a player may trade for only two Defensive Pool pieces during the course of a game.

Play continues until one player completes a path from his designated starting side to his ending side. When two or three players are playing a game, the creation of a path using the playing pieces from any one of the player's starting spaces to any one of their ending spaces is a winning path. When four or six players are playing the game, a winning path is defined from the starting space labeled No. 1 to the ending space labeled No. 1 or from the starting space labeled No. 2 to the ending space labeled No. 2 or from the starting space labeled No. 3 to the ending space labeled No. 3.

If a player uses up all of his offensive pieces during the course of play, the other players continue with their remaining pieces and if they are able to complete a path, they are declared the winner. If a path is unable to be completed by any player, the game is a draw. Also, if through defensive play, players have created a situation in which no complete path is possible, the game is a draw. A path may be defined from the starting to the ending spaces even though it may roam anywhere on the board even through an opponent's starting or ending spaces.

Variations and Handicapping

A difference in skill level between an experienced player and a beginner can be compensated for in several ways. For instance, the defensive capability of the experienced player may be reduced and/or the offensive capability of the inexperienced player may be increased. Alternatively, the offensive capability of the experienced player may be reduced and/or the defensive capability of the inexperienced player may be increased. Yet another means for handicapping may be accomplished by requiring that the experienced player be required to trade more than two of his offensive pieces for a piece from the defensive pool. As a further example of handicapping which might be used where, for instance, an experienced adult is playing an inexperienced young person, the young person might be permitted to play using a set comprising for instance 33 offensive pieces and eleven defensive pieces and, at the same time, the experienced player would be required to trade four of his offensive pieces for each piece from the Defensive Pool. As an example of less extreme handicapping, the less capable player might be given one additional defensive piece. The exact trade-offs between offensive and defensive players of other than equal skill can be decided among the players, as by means of an appropriate handicapping system based upon past performance.

Several variations on the basic game are available. For instance, when four or six players are playing, they may be divided into teams. For instance, with six players either two three-man teams or three two-man teams may be formed. Team members may consult before the game and decide that one, or more, will play defensively and the other member or members will play offensively. The team which first completes any "path" is declared the winner. In another variation on the basic game, two players can play two sets of pieces using starting and ending spaces designated when four players are playing. The first player to complete two paths is declared the winner. Alternatively, they can count each successful "path" one point and continue to play until all offensive pieces have been played. The player with the most points at the end of the game is declared the winner. In another variation on the basic game, players may decide on different paths than those prescribed in the rules of the game. Each player should generally have paths of equal length using this particular variation.

While the preferred embodiments of the invention have been illustrated and described herein, and while several variations on the basic game have also been set forth, it is to be understood that the invention is not to be construed as limited thereby and that various changes and modifications in the form, construction, arrangement and combination of the path and steps of the game apparatus may be substituted for those herein shown and described without departing from the nature and principle of the invention.

I claim:

1. A game apparatus for two or more players comprising a game board, a variety of different types of offensive playing pieces and defensive playing pieces all in the shape of equilateral hexagons in which:

A. said game board is provided with a matrix of contiguous hexagonally-shaped spaces of about the same size and shape as said offensive and said defensive playing pieces;

B. said offensive pieces are provided for each player in a set including a variety of different types of pieces for each player, each offensive piece being characterized by the presence of at least one path therethrough defined by a distinctively identified interior segment and two or more distinctively identified peripheral segments which adjoin the edge of the piece and the interior segment; and C. said defensive pieces are of about the same exterior dimensions as said offensive pieces but are further characterized by the absence of any path-defining, distinctively identified interior segments, although said defensive pieces may include one or more distinctively identified peripheral segments which adjoin the edges of the piece and said interior segment.

2. A game apparatus as recited in claim 1, wherein said apparatus is further provided with offensive-defensive pieces which have characteristics of both said offensive and defensive pieces since a path therethrough is provided as in said offensive pieces but wherein further the path proceeding from at least one distinctively identified peripheral segment which adjoins an edge of the piece is interrupted.

3. A game apparatus as recited in claim 1 wherein the exterior dimensions of said playing pieces are in the shape of an equilateral hexagon and said peripheral segments are defined by the area of the piece lying between one or more edges of said hexagon and said interior segment.

4. A game apparatus as recited in claim 3 wherein said interior segment is an equilateral hexagon.

5. A game apparatus as recited in claim 1 wherein the exterior dimensions of said matrix of contiguous spaces is in the shape of an equilateral hexagon.

6. A game apparatus as recited in claim 5 wherein said game board is a flat playing surface and said contiguous spaces are printed on said surface.

7. A game apparatus as recited in claim 5 wherein said game board is made of plastic and wherein said contiguous matrix of spaces is molded in said plastic.

8. A game apparatus as recited in claim 5 wherein said game board is made of inlaid wood, wherein the inlays are in the shape of the hexagonal playing spaces.

9. A game apparatus as recited in claim 2 wherein said playing spaces are provided with a recess which will accept similarly shaped protuberances on the bottom of said playing pieces in order to anchor them in place.

10. A game apparatus as recited in claim 5 wherein said game board is made of non-magnetized or magnetized metal and said playing pieces are also made of metal which is magnetized and non-magnetized if the board is magnetized.

* * * * *